US007847177B2

(12) United States Patent
Thirumoorthy

(10) Patent No.: US 7,847,177 B2
(45) Date of Patent: Dec. 7, 2010

(54) DIGITAL COMPLEX TONE GENERATOR AND CORRESPONDING METHODS

(75) Inventor: Hari Thirumoorthy, Chandler, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 91 days.

(21) Appl. No.: 12/220,349

(22) Filed: Jul. 24, 2008

(65) Prior Publication Data

US 2010/0018383 A1 Jan. 28, 2010

(51) Int. Cl.
*G10H 1/00* (2006.01)

(52) U.S. Cl. ..... 84/623; 84/624; 84/659; 84/660

(58) Field of Classification Search ..... 84/623, 84/624, 659, 660; 700/94
See application file for complete search history.

(56) References Cited

U.S. PATENT DOCUMENTS

| | | | | |
|---|---|---|---|---|
| 3,941,024 | A | 3/1976 | Brand et al. | |
| 3,954,038 | A | 5/1976 | Adams | |
| 3,956,961 | A * | 5/1976 | Peterson | 84/675 |
| 4,084,472 | A | 4/1978 | Niimi | |
| 4,259,888 | A | 4/1981 | Gross | |
| 4,286,491 | A | 9/1981 | Deutsch | |
| 4,300,434 | A | 11/1981 | Deutsch | |
| 4,333,377 | A | 6/1982 | Niezgoda et al. | |
| 4,351,219 | A | 9/1982 | Bass | |
| 4,394,743 | A | 7/1983 | Mercer | |
| 4,406,926 | A | 9/1983 | Duncan | |
| 4,440,058 | A | 4/1984 | Bass et al. | |
| 4,446,770 | A | 5/1984 | Bass | |
| 4,541,088 | A | 9/1985 | Sarson | |
| 5,040,448 | A * | 8/1991 | Matsubara et al. | 84/622 |
| 5,136,912 | A | 8/1992 | Morikawa et al. | |
| 5,258,574 | A * | 11/1993 | Kawano | 84/661 |
| 5,286,916 | A * | 2/1994 | Yamauchi | 84/661 |
| 5,384,807 | A | 1/1995 | Yatim et al. | |
| 5,448,010 | A * | 9/1995 | Smith, III | 84/622 |
| 5,500,486 | A * | 3/1996 | Smith, III | 84/622 |
| 5,587,548 | A * | 12/1996 | Smith, III | 84/659 |
| 5,748,513 | A | 5/1998 | Van Duyne | |

(Continued)

FOREIGN PATENT DOCUMENTS

JP 01278104 A * 11/1989

OTHER PUBLICATIONS

Gunter Schmer, MTA; DTMF Tone Generation and Detection:An Implementation Using the TMS320C54x; Texas Instruments; May 2000.

*Primary Examiner*—David S. Warren
(74) *Attorney, Agent, or Firm*—Charles W. Bethards

(57) ABSTRACT

Digital complex tone generators include a first tone generator configured to generate a first digital tone with selectable first characteristics including a first frequency, a first phase, and a first amplitude; a second tone generator configured to generate a second digital tone with selectable second characteristics including a second frequency, a second phase, and a second amplitude; and a generator adder configured for combining the first tone and the second tone to provide a digital complex tone with programmable characteristics. Corresponding methods include initializing a first and second tone generators based on, respective, selected frequencies, phases, and amplitudes; iteratively generating a first digital tone and a second digital tone; and combining these two tones to provide the digital complex tone.

17 Claims, 2 Drawing Sheets

U.S. PATENT DOCUMENTS 5,763,800 A * 6/1998 Rossum et al. ..... 84/603
5,777,255 A * 7/1998 Smith et al. ..... 84/661
5,900,570 A * 5/1999 Rossum ..... 84/653
6,011,213 A * 1/2000 Duruoz ..... 84/703
6,091,269 A * 7/2000 Rossum ..... 327/107
6,232,903 B1 5/2001 Koifman et al.
6,285,767 B1 * 9/2001 Klayman ..... 381/17
6,611,592 B1 8/2003 Sato et al.
6,628,999 B1 * 9/2003 Klaas et al. ..... 700/94
6,647,119 B1 * 11/2003 Slezak ..... 381/17
6,952,621 B1 * 10/2005 Malcolm et al. ..... 700/94
7,466,817 B2 * 12/2008 Toda ..... 379/361
2003/0093730 A1 * 5/2003 Halder et al. ..... 714/724
2004/0158470 A1 * 8/2004 Kawahara et al. ..... 704/266
2004/0184559 A1 * 9/2004 Ballantyne ..... 375/300
2007/0079689 A1 * 4/2007 Saado et al. ..... 84/604
2007/0137465 A1 * 6/2007 Lindemann ..... 84/626
2007/0160216 A1 * 7/2007 Nicol et al. ..... 381/17

* cited by examiner

DIGITAL COMPLEX TONE GENERATOR AND CORRESPONDING METHODS

FIELD OF THE INVENTION

This invention relates in general to digital complex tone generation and apparatus and methods configured to generate a digital complex tone.

BACKGROUND OF THE INVENTION

Tone generators and generation of tones are known. Such apparatus and methods are used in music synthesizers and products such as some keyboard instruments and the like. Tone generators, i.e., sine wave generators, are also used for testing and calibration of more complex systems, e.g., integrated circuit transceivers and systems, found in cell phones and the like. By including a tone generator that is integral to or integrated with these systems, the systems can be arranged to essentially self test and calibrate with the application of power and little if anything else coupled to the system. A tone generator that is integral with a system needs to be highly efficient in terms of silicon usage and even minor improvements in silicon area can be significant, since the tone generator is, for the most part, overhead and contributes little if anything to the functionality of the actual system.

Furthermore it is important that the properties of the generated tone be adjustable over wide ranges of characteristics. One known way to generate a tone is to store values corresponding to the tone in read only memory. If one stores values at a maximum sampling rate and corresponding to a lowest desired frequency one will be able to read out those values and thus generate a digital tone at the lowest desired frequency or at frequencies that are integer multiples of that lowest frequency, e.g., every other value will be a tone at twice the lowest frequency. This technique takes significant silicon area and usually does not provide sufficient flexibility in tone characteristics.

BRIEF DESCRIPTION OF THE DRAWINGS

The accompanying figures where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

In overview, the present disclosure concerns digital complex tone generation, e.g., one or more methods and apparatus for so doing, and more specifically techniques and apparatus for digital complex tone generation that are arranged and constructed for very accurate tone generation which is very efficient in silicon area and thus suitable for implementation as an integral system or generator for use in self calibration and testing of more complex systems, e.g., receivers and transmitters for cellular telephones and the like. Self testing and calibration lower costs of manufacturing products, which include the systems or integrated circuits that are self calibrating, etc.

The instant disclosure is provided to further explain in an enabling fashion the best modes, at the time of the application, of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms, if any, such as first and second, top and bottom, and the like are used solely to distinguish one from another entity or action without necessarily requiring or implying any actual such relationship or order between such entities or actions.

Much of the inventive functionality and many of the inventive principles are best implemented with or in integrated circuits (ICs) including possibly application specific ICs or ICs with integrated processing controlled by embedded software or firmware or various combinations thereof. It is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation. Therefore, in the interest of brevity and minimization of any risk of obscuring the principles and concepts according to the present invention, further discussion of such firmware, software, and ICs, if any, will be limited to the essentials with respect to the principles and concepts of the various embodiments.

Figure 1:
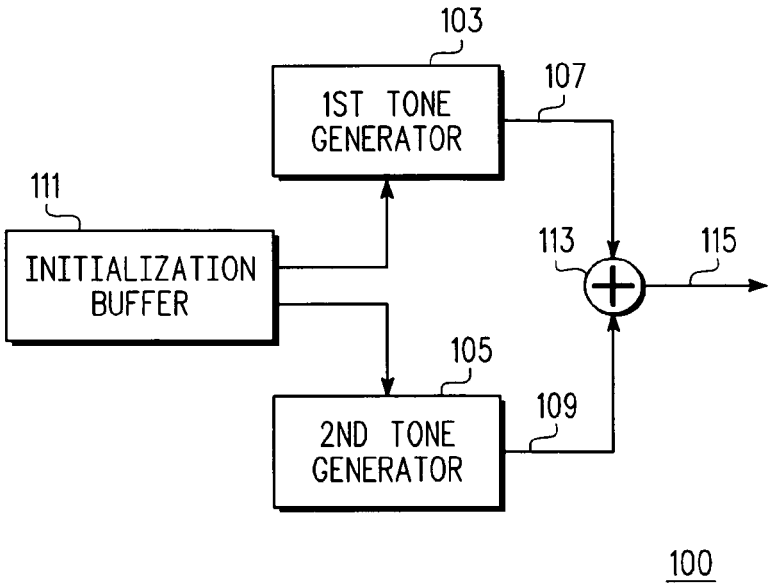
FIG. 1 depicts in a simplified and representative form, a high level block diagram of a digital complex tone generator in accordance with one or more embodiments.

Referring to FIG. 1, a simplified and representative high level block diagram of a digital complex tone generator in accordance with one or more embodiments will be briefly discussed and described. FIG. 1 illustrates a digital complex tone generator 100 which is arranged and configured to provide a digital complex tone, i.e., sequence of digital words at a clock rate or sample rate $f_{SAMP}$, where the length of the words will determine the accuracy or precision of the complex tone generator output and the clock frequency or rate or sample rate will determine the upper frequency for the digital complex tone that can be generated, i.e., the desired frequency of the generated complex tone can have a desired frequency $f_d$ up to but less than $f_{SAMP}/2$.

The digital complex tone generator 100 is comprised of a first tone generator 103 and a second tone generator 105, which are configured to generate and provide a, respective, first and a second digital tone at outputs 107, 109. As will be further described below each of the first and the second tone generator can be comprised of a, respective, first and second infinite impulse response (IIR) filter, where each IIR filter is initialized and configured as an oscillator (two delay stages with output coupled back to input, etc.). Each of the first and second tone generators, i.e., each of the IIR filters, can be initialized with values from an initialization buffer 111 as illustrated. The initialization values can be based on programmable characteristics including one or more of a desired frequency, phase, and amplitude, associated with the, respective, first and second digital tone. In a typical embodiment, each tone generator 103, 105 will produce a digital tone with the same desired frequency and same desired amplitude; however the first and the second digital tones will have a different respective desired phase or a relative phase between the first and second digital tone. For example, one of the tone generators may be initialized to produce a digital tone with zero phase, while the other produces a digital tone with a non-zero phase, e.g., 90 degree phase for orthogonal digital tones. The outputs of the first and second tone generators, i.e., the first and second digital tones are coupled to a generator adder 113. The generator adder 113 can be configured for combining the first digital tone and the second digital tone to provide a digital complex tone with programmable characteristics.

As will be further discussed herein below, each of the IIR filters for the respective first and second tone generators is comprised of first and second delay stages, a multiplier, an inverter or twos complement negative and an adder. The first delay stage can be initialized with a value proportional to the sine of the, respective, first and second desired phase, sin(t) which can be determined from the relative phase. The second delay stage can be initialized with a value proportional to sine of the, respective, negative desired frequency added to the, respective, first and second desired phase, $\sin(-\omega_d+t)$, where $\omega_d=2\pi f_d/f_{SAMP}$. The multiplier can be used for weighting an output of the first delay stage by a value proportional to 2 times cosine of the, respective, desired frequency, $2\cos(\omega_d)=2\cos(2\pi f_d/f_{SAMP})$. The adder is configured to provide the, respective, first or second digital tone by combining an output of the multiplier and an output of the inverter, where the inverter is coupled to an output of the second delay stage.

The digital complex tone generator 100 can be arranged and configured to iteratively provide a sequence of N bit twos complement words corresponding to the digital complex tone at a word or sample rate of $f_{SAMP}$ and desired frequency of $f_d$ up to $f_{SAMP}$ divided by two (2) along with a desired or selectable or programmable phase and amplitude. As will be more fully discussed below, the first and second IIR filters or constituent delay stages may be periodically reinitialized to there respective initial states. This can overcome drift due to cumulative errors resulting from quantization errors, if needed.

An overview of a digital complex tone generator 100 has been illustrated by FIG. 1 and discussed above. The digital complex tone generator 100 comprises a first tone generator 103 configured to generate a first digital tone available at output 107 with selectable first characteristics including a first frequency, a first phase, and a first amplitude. The digital complex tone generator 100 further comprises a second tone generator 105 configured to generate a second digital tone available at output 109 with selectable second characteristics including a second frequency, a second phase, and a second amplitude. Additionally, the digital complex tone generator 100 comprises a generator adder 113 configured for combining the first tone and the second tone to provide a digital complex tone with programmable characteristics available at output 115. In one embodiment both tone generators generate a digital tone with the same frequency and same amplitude but with different phases, e.g., 90 degrees.

Figure 2:
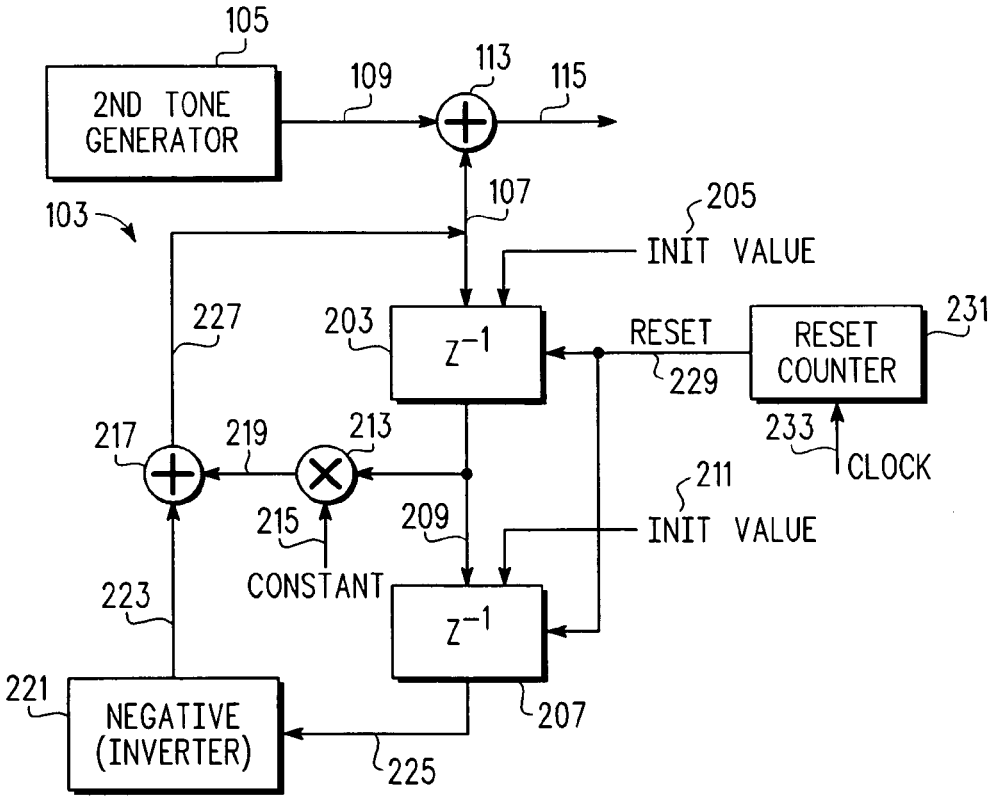
FIG. 2 illustrates a more detailed block diagram of one tone generator portion of the digital complex tone generator of FIG. 1 in accordance with one or more embodiments.

Referring to FIG. 2, a more detailed block diagram of one tone generator portion of the digital complex tone generator of FIG. 1 in accordance with one or more embodiments will be briefly discussed and described. FIG. 2 shows a more detailed embodiment of one of the two tone generators in FIG. 1, e.g., an embodiment of the first tone generator 103 or the second tone generator 105. Most of the discussion of FIG. 2 will be in the context of the first tone generator 103, where it is understood that the second tone generator 105 is similarly configured, albeit with possibly different initialization values. It is also understood that the block diagram of FIG. 2 is driven by a common clock operating at a given clock rate or clock frequency or sample rate, which clock is not shown for all functions. Typically the functions depicted in FIG. 1 will be performed in hardware but as will be appreciated by those of ordinary skill given the present disclosure, these functions can also be performed in a processor with appropriate software instructions, e.g., firmware for integral or integrated embodiments. Additionally the bus width throughout FIG. 2 is sufficient to couple twos complement numbers (i.e., numbers with a sign where a leading or left hand 0 indicates a positive number and a leading 1 indicates a negative number) with sufficient width to accommodate the desired or selected amplitudes, phase, and frequency with sufficient precision. One embodiment uses 24 bit twos complement numbers comprising a sign bit, 2 bits to provide amplitudes varying between +/−4 with the remaining 21 bits devoted to precision. Larger numbers and greater precision can be used, if smaller quantization errors and resultant drift are required or if the complex digital tone needs to be provided for longer periods of time. As noted below, in some embodiments a periodic reset can be used to resolve drift issues.

The first tone generator 103 can further comprise a first delay stage 203 that is initialized at 205 with a value (from the initialization buffer 111) that is based on the first phase. In one or more embodiments, the first delay stage can be initialized with a value proportional to the sine of the first phase, e.g., where the proportionality value is the desired or first amplitude, i.e. A sin(t). In varying embodiments, the first tone generator can further comprises a second delay stage 207 with an input coupled to an output at 209 of the first delay stage 203, where the second delay stage can be initialized at 211 with a value (from initialization buffer 111), which value is based on the first frequency and the first phase. In one or more embodiments, the second delay stage that can be initialized with a value proportional to a sine of the negative first frequency added to the first phase, e.g., $A\sin(-2\pi f_d/f_{SAMP}+t)$, where A is the first or first selected amplitude.

The first tone generator 103 further comprises a multiplier 213 that is coupled to the output of the first delay stage at 209 and configured to weight the output of the first delay stage by a value or multiplier constant, which is available from the initialization buffer at 215, where the value is based on the first frequency. In some embodiments, the multiplier can be configured to weight the output of the first delay stage by a value proportional to cosine of the first frequency, e.g., $2\cos(2\pi f_d/f_{SAMP})$.

The first tone generator 103 in one or more embodiments further comprises a first adder 217 that is arranged and configured to add an output from the multiplier at 219 and an inverse, provided by inverter 221 at 223 of an output at 225 of the second delay stage 207 and provide the first digital tone at 227. The first digital tone at 227 is coupled to an input of the first delay stage and to an input of the generator adder at 107. As shown, the second tone generator 105 provides the second tone at 109 to the generator adder 113 and the sum of these tones results in the digital complex tone at 115.

The first and second delay stages 203, 207 and the corresponding delay stages in the second tone generator can be reset via reset input 229, which is a synchronous reset input. The digital complex tone generator can include a reset counter 231 that is coupled to the reset input 229 of the first and the second delay stage and configured to provide a reset signal to re-initialize the first delay stage and the second delay stage periodically. The reset counter 231 counts clock edges from a common clock at input 233 operating at a clock frequency or sample rate. In some embodiments, where the tone frequency or first frequency and the clock frequency or sample rate $f_{SAMP}$ have an M/N smallest positive integer ratio, the reset counter can provide the reset signal whenever the number of clock edges reaches the least-common-multiple of M, N, i.e., a product of M times N divided by the greatest common divisor of M, N. This can be further appreciated from the following comments. The reset counter can be used to reset the second tone generator as well, particularly in embodiments arranged to generate the same tone frequency. In some embodiments the reset counter needs to be able to count at the clock or sample rate and should have a maximum count on the order of 100 times L=LCM(M,N) for the highest frequency desired tone.

In digital circuits there are quantization errors since a particular value is only accurate to the word length that is being used. In recursive circuits, such as IIR filters or other feedback circuits these quantization errors can accumulate over time. In the digital complex tone generator if the digital complex tone is generated for too much time these accumulated quantization errors or noise can result spur generation or quantization noise growth. If the values for tone frequency are limited to frequencies $f_d$ such that $f_d/f_{SAMP}=M/N$, where M and N are positive integers and 2M<N, a reset rate can be determined, which will eliminate any drift or noise growth issues.

Let L=least-common-multiple(M, N)=M*N/greatest-common-divisor (M,N) and consider $x[n]=\sin(2*\pi*f_d*n/F_{SAMP})$ and $x[n+L]=\sin(2*\pi*f_d*(n+L)/F_{SAMP})$. Then, $x[n+L]=\sin(2*\pi*M*(n+L)/N)=\sin(2*\pi*M*n/N+2*\pi*L*n/N)=\sin(2*\pi*M*n/N+2*\pi*K*n)$ where K=some integer, and thus x[n+L]=x[n] exactly. Therefore if a synchronous reset is performed at the rate of L, any drift issues are resolved. As an example of this approach in use, suppose $f_{SAMP}$=6.5 MHz and a possible $f_d$=83 KHz. The ratio of these can be approximated as 16/1253, which would imply an actual generated tone frequency of 83,000.798 or a difference of less than 0.799 Hz from the possible $f_d$. L would equal 20048 samples, i.e., reset every 20048 samples=16(1253)/GCD (16, 1253) or about one reset for every 3 milli seconds. If the bit width of signals and multipliers is large enough to avoid significant drift in these time spans, the tone generator can operate for any time span. To be more accurate in tone frequency, we could use M=83 and N=6500 and get the exact $f_d$=83 KHz; however L=539,500 samples or about once every 83 milli seconds.

The tone generator discussed above functions based on the following observations. It is known that a two stage IIR filter provides an output that is a combination of a present input and weighted combinations of previous outputs. This can be expressed as follows:

$$y[n]=-a1*y[n-1]-a2*y[n-2]+b0*x[n], \text{ where}$$

y[n]=output sequence,
n=discrete-time,
x[n]=input sequence,
a1, a2, b0 are constants Suppose we want $h[n]=\sin((n+1)*\omega_0+t)$, i.e. a sine wave with selectable frequency, $\omega_0=2\pi f_0$, and phase, t. From trigonometry we can write this as:

$$h[n] = 2*\sin(n*\omega_0+t)*\cos(\omega_0) - \sin((n-1)*\omega_0+t)$$

$$= h[n-1]*(2*\cos(\omega_0)) + h[n-2]*(-1)$$

Setting n=0,−1,−2 we get, respectively, $h[0]=\sin(\omega_0+t)$, $h[-1]=\sin(t)$, $h[-2]=\sin(-\omega_0+t)$. Note that an amplitude, A, merely multiplies the two terms, h[n−1], h[n−2], i.e., by scaling each memory element, h[n−1], h[n−2], by A, a selectable amplitude can be provided. Thus if we set the initial conditions as noted above, we can do a sine wave generator with controllable, programmable or selectable, frequency, phase, and amplitude. By providing two tone generators and selecting different phases a digital complex tone generator can be realized.

Figure 3:
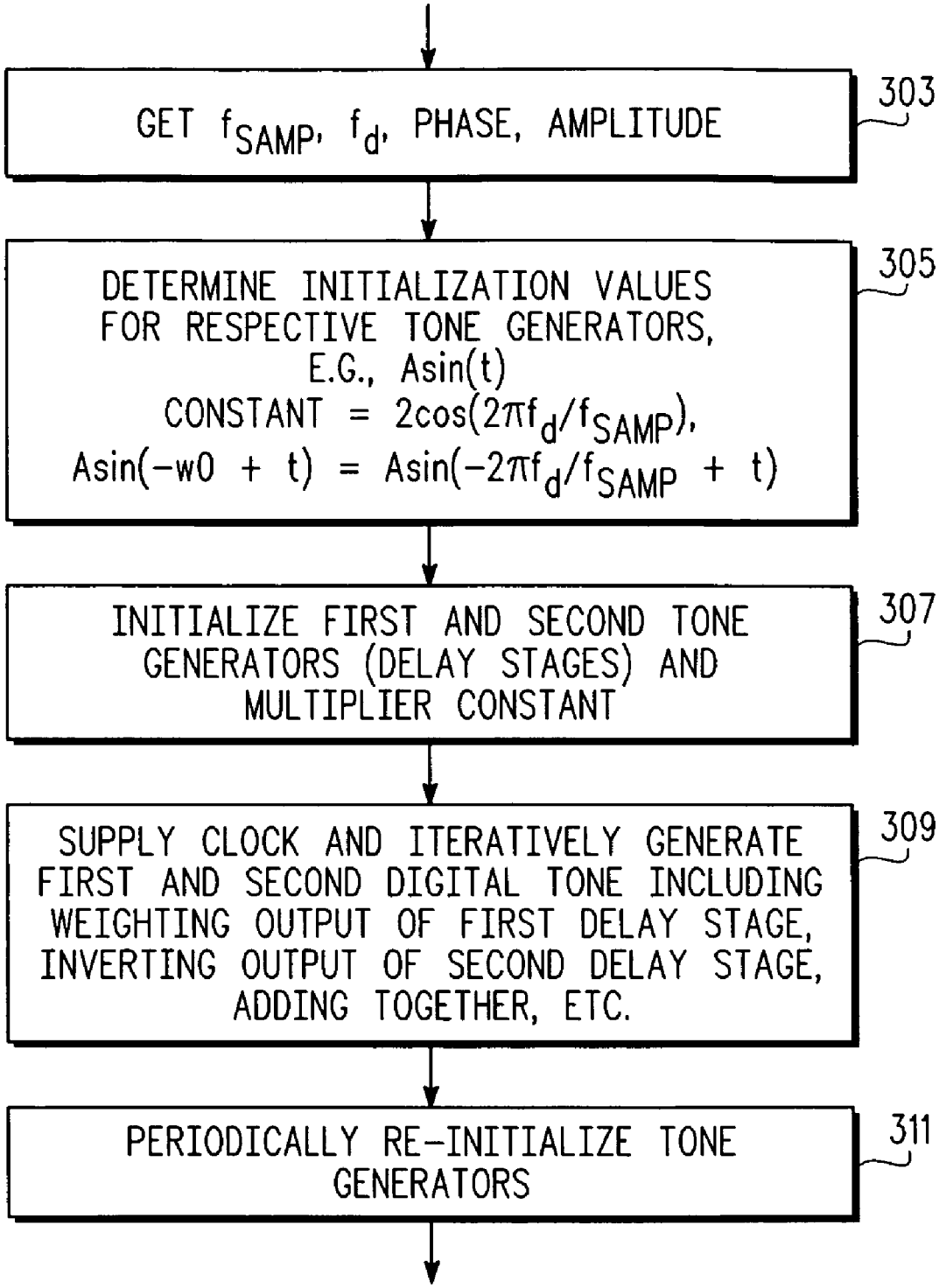
FIG. 3 shows a flow chart of representative methods of generating a digital complex tone executed, e.g., in conjunction with the digital complex tone generator of FIG. 1, in accordance with one or more embodiments.

Referring to FIG. 3, a flow chart of representative methods of generating a digital complex tone in accordance with one or more embodiments will be discussed and described. The methods of FIG. 3 can be executed in part by the apparatus of FIG. 1 and FIG. 2 or other apparatus with appropriate functionality. The process shown by FIG. 3 is one of generating a digital complex tone where the frequency and amplitude of two tone generators are equal and the difference between the tone generators and tones generated is the relative phase. In many instances this phase difference will be π/2.

FIG. 3 begins by getting or obtaining basic functional parameters for generating a digital complex tone, such parameters including the sampling or clock rate, $f_{SAMP}$, the desired or selected frequency, $f_d$, phase or relative phase, t, and amplitude 303. Then determining initialization values for the first and second tone generators is performed 305. The determining initialization values for the first tone generator and the second tone generator can be based on a clock frequency, a selected frequency, and a relative angle or phase between the first digital tone and the second digital tone. This can include for respective tone generators determining A sin(t); a multiplier constant=$2\cos(2\pi f_d/f_{SAMP})$; and $A\sin(-\omega_0+t)=A\sin(-2\pi f_d/f_{SAMP}+t)$ where all of these values will need to be determined to the appropriate level of precision and the values including or depending on "t" may need to be determined for each tone generator.

With the initialization values, a method of generating a digital complex tone can comprise initializing a first tone generator based on a selected first frequency, first phase, and first amplitude and initializing a second tone generator based on a selected second frequency, second phase, and second amplitude 307. As noted above in one or more embodiments the first and second frequency and amplitudes can be equal. In more detail, the initializing a first tone generator further comprises initializing a first delay stage in an infinite impulse response (IIR) filter with a value proportional to sine of the selected first phase, initializing a second delay stage in the IIR filter with a value proportional to sine of the sum of a negative of the selected first frequency and the selected first phase, $\sin(-2\pi f_d/f_{SAMP}+t)$, and initializing a multiplier with a first constant value proportional to or equal to two times cosine of the selected first frequency, $2\cos(2\pi f_d/f_{SAMP})$. The initializing the second tone generator comprises analogous initializing processes for associated delay stages and a multiplier.

A first proportionality coefficient equal to the selected first amplitude can be utilized in the initializing steps for the first tone generator, i.e., initializing the associated delay stages, and a second proportionality coefficient equal to the selected second amplitude can be utilized in the analogous initializing steps for the second tone generator. It is noted that the amplitude of the digital complex tone can be adjusted with a multiplier coupled to the digital complex tone, however this would necessitate a complex multiplication for each word, whereas if the selected or desired amplitude is included with initialization values for the delay stages, this multiplication process will not be required.

The method of generating a digital complex tone further comprises iteratively generating a first digital tone with the first tone generator and a second digital tone with the second tone generator 309. More specifically, this includes supplying a clock and clocking the first tone generator and the second tone generator, weighting an output of the first delay stage with the first constant value using the multiplier to provide a multiplier output, inverting the output of the second delay stage to provide an inverter output, and adding, with a first adder, the multiplier output to the inverter output to provide the first digital tone and coupling the first digital tone to an input of the first delay stage. For the second tone generator, performing analogous weighting, inverting, and adding steps to provide the second digital tone is performed.

As depicted in FIG. 3, the method of generating a digital complex tone can include 311 periodically resetting the first tone generator and the second tone generator to there, respective, initialized state. In particular this means resetting each of the delay stages to there original initialized values as discussed above.

The processes, apparatus, and systems, discussed above, and the inventive principles thereof can provide a more space efficient approach to generating a digital complex tone than prior art techniques. Using the principles noted above in one or more embodiments that use 24 bit arithmetic yields performance parameters including greater than 70 dB c spur free dynamic range, less that −100 dBc noise floor, greater than 68 dBc image rejection (ability to maintain appropriate phase relation ship between digital tones) and minimal hardware requirements.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A digital complex tone generator comprising:

a first tone generator configured to generate a first digital tone with selectable first characteristics including a first frequency, a first phase, and a first amplitude;

a second tone generator configured to generate a second digital tone with selectable second characteristics including a second frequency, a second phase, and a second amplitude; and a generator adder configured for combining the first digital tone and the second digital tone to provide a digital complex tone with programmable characteristics, wherein the first tone generator further comprises a first delay stage that is initialized with a value based on the first phase and a second delay stage with an input coupled to an output of the first delay stage, the second delay stage initialized with a value based on the first frequency and the first phase.

2. The digital complex tone generator of claim 1 wherein the first tone generator further comprises a first delay stage that is initialized with a value proportional to the sine of the first phase.

3. The digital complex tone generator of claim 1 wherein the first tone generator further comprises a second delay stage that is initialized with a value proportional to a sine of the negative first frequency added to the first phase.

4. The digital complex tone generator of claim 1 wherein the first tone generator further comprises a multiplier coupled to the output of the first delay stage and configured to weight the output of the first delay stage by a value based on the first frequency.

5. The digital complex tone generator of claim 4 wherein the first tone generator further comprises a multiplier coupled to the output of the first delay stage and configured to weight the output of the first delay stage by a value proportional to two times cosine of the first frequency.

6. The digital complex tone generator of claim 4 wherein the first tone generator further comprises a first adder configured to add an output from the multiplier and an inverse of an output of the second delay stage and provide the first digital tone, the first digital tone coupled to an input of the first delay stage and to an input of the generator adder.

7. The digital complex tone generator of claim 6 further comprising a reset counter coupled to a reset input of the first delay stage and the second delay stage and configured to provide a reset signal to re-initialize the first delay stage and the second delay stage periodically.

8. The digital complex tone generator of claim 7 wherein the reset counter counts clock edges from a common clock operating at a clock frequency, wherein the first frequency and the clock frequency have an M/N smallest positive integer ratio, and wherein, when the number of clock edges reaches a least common multiple of M, N, the reset counter provides the reset signal.

9. A digital complex tone generator comprising:

a first and a second tone generator configured to generate and provide a, respective, first and second digital tone, wherein the first and the second tone generator are comprised of a, respective, first and second infinite impulse response (IIR) filter, each of the first and second IIR filters initialized with values based on a desired frequency, desired amplitude, and relative phase, associated with the respective first and second digital tone; and a generator adder configured for combining the first digital tone and the second digital tone to provide a digital complex tone with programmable characteristics, wherein the digital complex tone generator is further configured to iteratively provide a sequence of N bit twos complement words corresponding to the digital complex tone at a sample rate of $f_{SAMP}$ and desired frequency of $f_d$ up to $f_{SAMP}$ divided by two.

10. The digital complex tone generator of claim 9 wherein the first and second IIR filters are further configured with reset inputs that periodically reinitialize the first and second IIR filters to, respective, initial states.

11. A digital complex tone generator comprising:

a first and a second tone generator configured to generate and provide a, respective, first and second digital tone, wherein the first and the second tone generator are comprised of a, respective, first and second infinite impulse response (IIR) filter, each of the first and second IIR filters initialized with values based on a desired frequency, desired amplitude, and relative phase, associated with the respective first and second digital tone; and a generator adder configured for combining the first digital tone and the second digital tone to provide a digital complex tone with programmable characteristics, wherein each of the IIR filters is comprised of first and second delay stages, a multiplier, an inverter and an adder, the first delay stage initialized with a value proportional to a sine of a, respective, first and second desired phase determined from the relative phase, the second delay stage initialized with a value proportional to sine of a negative desired frequency added to the, respective, first and second desired phase, the multiplier weighting an output of the first delay stage by a value equal to 2 times cosine of the desired frequency, the adder configured to provide the, respective, first or second digital tone by combining an output of the multiplier and an output of the inverter, the inverter coupled to an output of the second delay stage.

12. The digital complex tone generator of claim 11 wherein the first and second IIR filters are further configured with reset inputs that periodically reinitialize the first and second IIR filters to, respective, initial states.

13. A method of generating a digital complex tone, the method comprising:

initializing a first tone generator based on a selected first frequency, first phase, and first amplitude;

initializing a second tone generator based on a selected second frequency, second phase, and second amplitude;

iteratively generating a first digital tone generator and a second digital tone with the second tone generator;

combining the first digital tone and the second digital tone to provide the digital complex tone; and determining initialization values for the first tone generator and the second tone generator, the initialization values based on a clock frequency, a selected frequency, a selected amplitude, and a relative phase between the first digital tone and the second digital tone.

14. A method of generating a digital complex tone, the method comprising:

initializing a first tone generator based on a selected first frequency, first phase, and first amplitude;

initializing a second tone generator based on a selected second frequency, second phase, and second amplitude;

iteratively generating a first digital tone with the first tone generator and a second digital tone with the second tone generator; and combining the first digital tone an the digital tone to the digital complex tone;

wherein the initializing a first tone generator further comprises:

initializing a first delay stage in an infinite impulse response (IIR) filter with a value proportional to sine of the selected first phase;

initializing a second delay stage in the IIR filter with a value proportional to sine of the sum of a negative of the selected first frequency and the selected first phase;

initializing a multiplier with a first constant value proportional to two times cosine of the selected first frequency; and, wherein the initializing the second tone generator comprises analogous initializing processes.

15. The method of generating a digital complex tone of claim 14 wherein a first proportionality coefficient equal to the selected first amplitude is utilized in the initializing steps for the first tone generator and a second proportionality coefficient equal to the selected second amplitude is utilized in the analogous initializing steps for the second tone generator.

16. The method of generating a digital complex tone of claim 14, wherein the iteratively generating a first digital tone with the first tone generator and a second digital tone with the second tone generator further comprises:

clocking the first tone generator and the second tone generator;

weighting an output of the first delay stage with the first constant value using the multiplier to provide a multiplier output;

inverting the output of the second delay stage to provide an inverter output;

adding, with a first adder, the multiplier output to the inverter output to provide the first digital tone and coupling the first digital tone to an input of the first delay stage; and for the second tone generator performing analogous weighting, inverting, and adding steps to provide the second digital tone.

17. A method of generating a digital complex tone, the method comprising:

initializing a first tone generator based on a selected first frequency, first phase, and first amplitude;

initializing a second tone generator based on a selected second frequency, second phase, and second amplitude;

iteratively generating a first digital tone with the first tone generator and a second digital tone with he second tone generator;

combining the first digital tone and the to provide the digital complex tone; and periodically resetting the first tone generator and the second tone generator to there, respective, initialized state, wherein the periodically resetting further comprises counting clock edges from a common clock operating at a clock frequency, wherein the first frequency and the clock frequency have an M/N positive integer ratio, and resetting the first tone generator and the second tone generator each time the number of clock edges reaches a least common multiple of M, N.

* * * * *

UNITED STATES PATENT AND TRADEMARK OFFICE

CERTIFICATE OF CORRECTION

PATENT NO. : 7,847,177 B2
APPLICATION NO. : 12/220349
DATED : December 7, 2010
INVENTOR(S) : Thirumoorthy It is certified that error appears in the above-identified patent and that said Letters Patent is hereby corrected as shown below:

Column 9 line 40 after the word tone please delete “an” and insert --and the second--
Column 9 line 40 after the word to please insert --provide--
Column 10 line 37 after the word with please delete “he” and insert --the--
Column 10 line 38 after the word the please insert --second digital tone--

Signed and Sealed this
Twenty-second Day of February, 2011

David J. Kappos

David J. Kappos
*Director of the United States Patent and Trademark Office*